US006932171B2

(12) United States Patent
Youan et al.

(10) Patent No.: US 6,932,171 B2
(45) Date of Patent: Aug. 23, 2005

(54) GROUND DRILLING MACHINE

(75) Inventors: Toyohiko Youan, Hirakata (JP); Kentaro Watanabe, Hirakata (JP); Eiichi Muramoto, Hirakata (JP); Kazuyuki Yamazaki, Hirakata (JP)

(73) Assignee: Komatsu Ltd., Tokyo (JP)

( * ) Notice: Subject to any disclaimer, the term of this patent is extended or adjusted under 35 U.S.C. 154(b) by 95 days.

(21) Appl. No.: 10/453,328

(22) Filed: Jun. 2, 2003

(65) Prior Publication Data

US 2003/0226691 A1 Dec. 11, 2003

(30) Foreign Application Priority Data

Jun. 7, 2002 (JP) ..... 2002-167683

(51) Int. Cl.[7] ..... E21B 10/60
(52) U.S. Cl. ..... 175/334; 175/393
(58) Field of Search ..... 175/334, 339, 175/341, 393, 417, 429, 424

(56) References Cited

U.S. PATENT DOCUMENTS 3,576,222 A * 4/1971 Acheson et al. ..... 175/67
4,673,045 A * 6/1987 McCullough ..... 175/339
4,930,586 A * 6/1990 Turin et al. ..... 175/25
4,991,667 A * 2/1991 Wilkes et al. ..... 175/61
5,148,880 A * 9/1992 Lee et al. ..... 175/393
5,651,420 A * 7/1997 Tibbitts et al. ..... 175/102
6,142,246 A * 11/2000 Dickinson et al. ..... 175/67
6,386,300 B1 * 5/2002 Curlett et al. ..... 175/65

* cited by examiner

*Primary Examiner*—Frank S. Tsay
(74) *Attorney, Agent, or Firm*—Frishauf, Holtz, Goodman & Chick, P.C.

(57) ABSTRACT

A ground drilling machine comprises a controller for automatically controlling the injection of working liquid according to the output signal output as a function of the rotating condition of the pilot head 20. When the pilot head 20 is driven forward or backward, working liquid can be injected by switching the working liquid transfer valve 111 so long as the pilot head 20 is revolving in order to improve the digging efficiency, the soil delivering efficiency and the cooling efficiency of the machine. The injection of working liquid can be suspended when the direction of propelling the pilot head 20 is shifted while stopping the revolution of the pilot head 20 because no working liquid is required for delivering the dug soil and cooling the leading body. Thus, working liquid can be injected always at an optimal rate depending on the rotating condition of the pilot head 20 to suppress any waste of working liquid and reduce the construction cost.

4 Claims, 14 Drawing Sheets

FIG. 8

| REVOLUTION / PROPELLING | FORWARD | BACKWARD | STOP |
|---|---|---|---|
| ADVANCEMENT | ○ | — | × |
| RETREAT | ○ | — | × |
| STOP | × | × | × |

GROUND DRILLING MACHINE

BACKGROUND OF THE INVENTION

1. Field of the Invention

This invention relates to a ground drilling machine. More particularly, the present invention relates to a ground drilling machine to be used for drilling holes under the ground for the purpose of laying gas pipes, electric power cables, sheaths pipes for signal cables, optical fiber cables, water supply pipes, drainage pipes and so on without openly excavating the ground and also for drilling holes in rock beds in order to set dynamite there for blasting.

2. Description of Related Art

In recent years, efforts have been made to develop ground drilling machines for drilling holes under the ground for the purpose of laying various pipes and cables without openly excavating the ground.

FIGS. 13 and 14 of the accompanying drawings schematically illustrate such a ground drilling machine 1. The illustrated ground drilling machine 1 comprises a horizontal drill unit 2 and a working liquid supply vehicle 3 for supplying working liquid to the horizontal drill unit 2. Rods 10 are sequentially fed out from the horizontal drill unit 2 in such a way that each succeeding rod is linked to the immediately preceding rod. A pilot head 20, which is a leading body, is rotatably fitted to the front end of the leading rod 10. Thus, a drill is formed by the rods 10 and the pilot head 20 and driven by the horizontal drill unit 2.

The ground drilling machine 1 is used with a horizontal drilling technique in order to lay pipes under the ground.

Firstly, the pilot head 20 is driven into the ground from an entrance pit A at a predetermined angle of inclination (10 to 20°). Then, after correcting the direction in which the pilot head 20 is propelled to a horizontal direction, the pilot head 20 is driven to rotate and dig the ground until it gets to starting pit B. Thereafter, the pilot head 20 is driven to rotate and dig a hole from the starting pit B to a destination pit C so as to produce a leading hole D. Between the starting pit B and the destination pit C, the position, the depth from the surface, the inclination, the rotary angle and so on of the pilot head 20 are detected by means of a magnetism detector located on the ground that detects the magnetic field produced by a transmitter (sonde) contained in the pilot head 20 so as to appropriately correct the direction in which the pilot head 20 is propelled while it is digging the leading hole D. During the digging operation, working liquid that may be clean water, muddy water or bentonite solution is supplied from a working liquid supply vehicle 3 and through the rods 10 and injected from the pilot head 20.

After digging the leading hole D, the pilot head 20 fitted to the front end is replaced by a reamer 30 for broadening the leading hole and the object of underground placement E that may be a pipe or a cable to be laid is connected to the reamer 30 by way of a swivel joint. Then, the reamer 30 is rotated back, while causing the reamer 30 to eject working liquid, and the object of underground placement E is drawn into the hole, while broadening the leading hole D by means of the reamer 30.

For the operation of laying the object of underground placement E under the ground, working liquid is constantly supplied from the working liquid supply vehicle 3 and injected from the pilot head 20 or the reamer 30 in order to improve the efficiency of digging and broadening the leading hole D, that of delivering dug soil to the pits B and C and that of cooling the pilot head 20 and the reamer 30. Therefore, the rate of consumption of working liquid during the operation is remarkably high and hence the operation is costly.

The dug soil that is delivered to the pits B and C is very muddy because working liquid has been added thereto. Therefore, it is not possible to carry it out by means of ordinary dump trucks and hence it is a customary practice to draw it into dedicated container by means of a vacuuming device and carry out the containers that are filled with mud. Hence, the mud carrying out operation is costly if compared with ordinary operations of simply carrying out soil. This problem can be serious particularly when the working liquid consumption rate is high and the amount of mud to be vacuumed is large.

On the other hand, the object of underground placement E is laid between the starting pit B and the destination pit C but the operation of laying the object E inevitably entails an operation of digging a hole from the entrance pit A to the starting pit B by means of the pilot head 20. To improve the efficiency of digging a hole from the entrance pit A to the starting pit B, the distance L of the hole should be reduced as much as possible so as to complete the operation of digging a hole in which the object of underground placement E is not laid within a very short period of time.

The necessity for reducing the digging time and improving the efficiency of the hole digging operation is not limited to the operation of digging a hole from the entrance pit A to the starting pit B but is also applicable to the operation of digging a hole from the starting pit B to the destination pit C. Thus, there is a strong demand for techniques that can solve the above identified problems.

SUMMARY OF THE INVENTION

In view of the above identified circumstances, it is therefore the first object of the present invention to provide a ground drilling machine that can operate with a reduced working liquid consumption rate in order to reduce the construction cost.

The second object of the present invention is to provide a ground drilling machine that can dig a hole highly efficiently.

According to the invention, there is provided a ground drilling machine comprising rods, a rod rotating mechanism for driving rods to rotate, a rod propelling mechanism for propelling rods, a leading body fitted to the front end of the rod and adapted to be rotated and propelled with the rod, an injection port arranged at the leading body and adapted to inject working liquid supplied by way of rods, a rotating condition detection section for detecting the rotating condition of the leading body and a flow rate control mechanism for controlling the flow rate of working liquid to be injected from the injection port according to the detection signal from the rotating condition detection section.

The expression of rotating condition of the leading body as used herein refers not only to the condition in which the leading body is rotating or the rotary motion of the leading body is stopped but also to the condition in which the leading body is rotating at high speed or at low speed, if it is rotating. The expression of controlling the flow rate of working liquid to be injected as used herein refers not only to increasing or decreasing the flow rate of working liquid to be injected but also to intermittently suspending the injection of working liquid for a predetermined digging distance. Furthermore, the expression of working liquid as used herein refers to any liquid that is used to improve the efficiency of digging a hole and broadening the dug hole by means of the leading body, that of delivering dug soil and that of cooling the leading body.

With a ground drilling machine having a configuration as described above, the flow rate control mechanism controls the flow rate of working liquid to be injected according to the detection signal output from the rotating condition detection section on the basis of the rotating condition of the leading body. Thus, for example, when the direction in which the leading body is propelled needs to be shifted during a digging operation, the operation of propelling the leading body is continued while only the rotary motion of the leading body is stopped as normal practice. Then, the dug soil is pressed so that its volume may be not very large and the heat generated by the digging operation may not be very remarkable because the leading body is not driven to rotate. Therefore, working liquid may well be injected at a relatively low rate for the purpose of delivering dug soil and cooling the leading body. Then, with a ground drilling machine according to the invention, the injection of working liquid may be suspended or the flow rate of working liquid may be reduced depending on the rotating condition of the leading body. In other words, working liquid is injected always at an optimal rate and hence any wasteful consumption of working liquid is avoided to reduce the construction cost.

Thus, the first object of the present invention is achieved with the above arrangement.

Preferably, a ground drilling machine according to the invention further comprises a propelling condition detection section for detecting the propelling condition of the leading body and the flow rate control mechanism is adapted to control the flow rate of working liquid to be injected from the injection port according to the detection signal from the propelling condition detection section.

With the above described arrangement of the ground drilling machine, if the leading body is being propelled or not is detected reliably according to the detection signal from the propelling condition detection section. Thus, for example, the condition where the leading body is neither rotated nor propelled and hence it is not being used for any digging operation can be reliably detected so that the injection of working liquid may be suspended in such a condition to further avoid any wasteful consumption of working liquid.

Preferably, a ground drilling machine according to the invention further comprises a rotary angle detection section for detecting the rotary angle of the leading body and the injection port is arranged so as to be able to inject working liquid in a direction offset from the axis of rotation of the leading body while the flow rate control mechanism is adapted to control the flow rate of working liquid to be injected from the injection port according to the detection signal from the rotary angle detection section.

With the above described arrangement of the ground drilling machine, it may be so arranged that working liquid is injected only when the rotary angle of the leading body is found within a predetermined angular range based on the detection signal from the rotary angle detection section. Then, the ground located in front of the dug hole may be loosened only partly and the direction in which the leading body is propelled may be shifted so that it may be propelled toward the loosened part of the ground. With a conventional ground drilling machine, the direction in which the leading body is propelled is shifted while the rotary motion of the leading body is suspended. To the contrary, with a ground drilling machine according to the invention, the direction in which the leading body is propelled can be shifted without suspending the rotary motion of the leading body so that the efficiency of digging soil while shifting the propelling direction is remarkably improved. Additionally, since working liquid is injected only when the rotary angle of the leading body is found within a predetermined angular range, the consumption rate of working liquid is reduced so that the first object of the present invention is achieved regardless of such an arrangement.

On the other hand, a ground drilling machine according to the invention may be so arranged as not to comprise the detection mechanism for detecting the rotating condition of the rod.

In this aspect of the invention, there is provided a ground drilling machine comprising rods, a rod rotating mechanism for driving rods to rotate, a rod propelling mechanism for propelling rods, a leading body fitted to the front end of the rod and adapted to be rotated and propelled with the rod, an injection port arranged at the leading body and adapted to inject working liquid supplied by way of rods and a flow rate control mechanism for suspending the injection of working liquid from the injection port in a condition where the digging leading body is propelled while its revolution is stopped.

Conventionally, working liquid is constantly being injected from the leading body when the slant-cutting surface is used to shift the direction in which the leading body is propelled in a state where its revolution is stopped. Thus, the ground is loosened over a large area at the front end of the dug hole by the injected working liquid so that the propelling direction can be hardly shifted until reaction force is generated at the leading body that is being propelled. In other words, the leading body can make a turn only with a large radius of curvature R (FIGS. 13, 14) so that consequently the hole dug from the entrance pit A to the starting pit B inevitably has a long distance L.

To the contrary, with a ground drilling machine according to the invention, when the direction in which the leading body is propelled is shifted in a state where its revolution is stopped, the injection of working liquid is completely or intermittently stopped by the flow rate control mechanism so that reaction force is easily generated at the leading body and consequently the length L of the hole dug from the entrance pit A to the starting pit B is reduced to improve the efficiency of the drilling operation. When the leading body is forced to make a turn between the starting pit and the destination pit in order to avoid an obstacle, it can turn with a small radius of curvature so that it can easily return to its proper drilling track. In other words, the digging operation can be conducted with an enhanced degree of freedom in terms of changing the direction of propelling the leading head.

Thus, the second object of the invention is achieved with the above arrangement.

BRIEF DESCRIPTION OF THE DRAWINGS

FIG. 8 is a schematic illustration of an operation of injecting working liquid and that of suspending the injection that will be conducted depending on the rotating condition and the propelling condition of the drill;

DETAILED DESCRIPTION OF THE PREFERRED EMBODIMENTS

Figure 13:
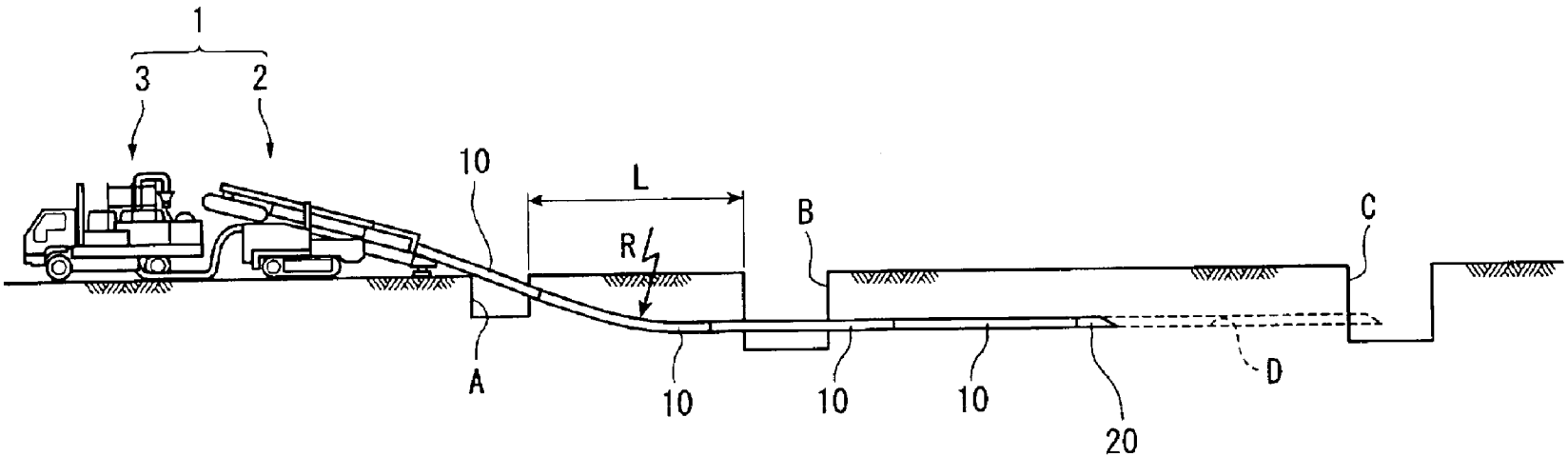
FIG. 13 is a schematic illustration of the related background art.
Figure 14:
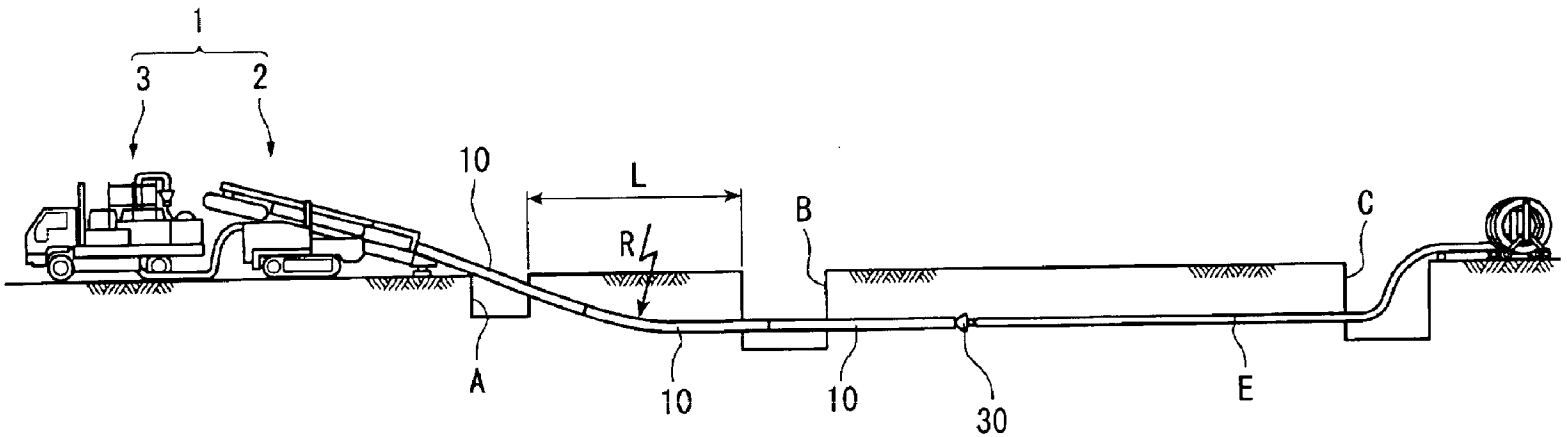
FIG. 14 is another schematic illustration of the related background art.

Now, the present invention will be described by referring to the accompanying drawings that illustrate preferred embodiments of the invention. In the drawings illustrating the first embodiment of the invention, the components thereof that are the same as or similar to those illustrated in FIGS. 13 and 14 and described above for the related background art are denoted respectively by the same reference symbols. In the drawings illustrating the second and other embodiments again, the components thereof that are the same as or similar to those of the first embodiment are denoted respectively by the same reference symbols and will not be described any further.

[1st Embodiment]

Figure 1:
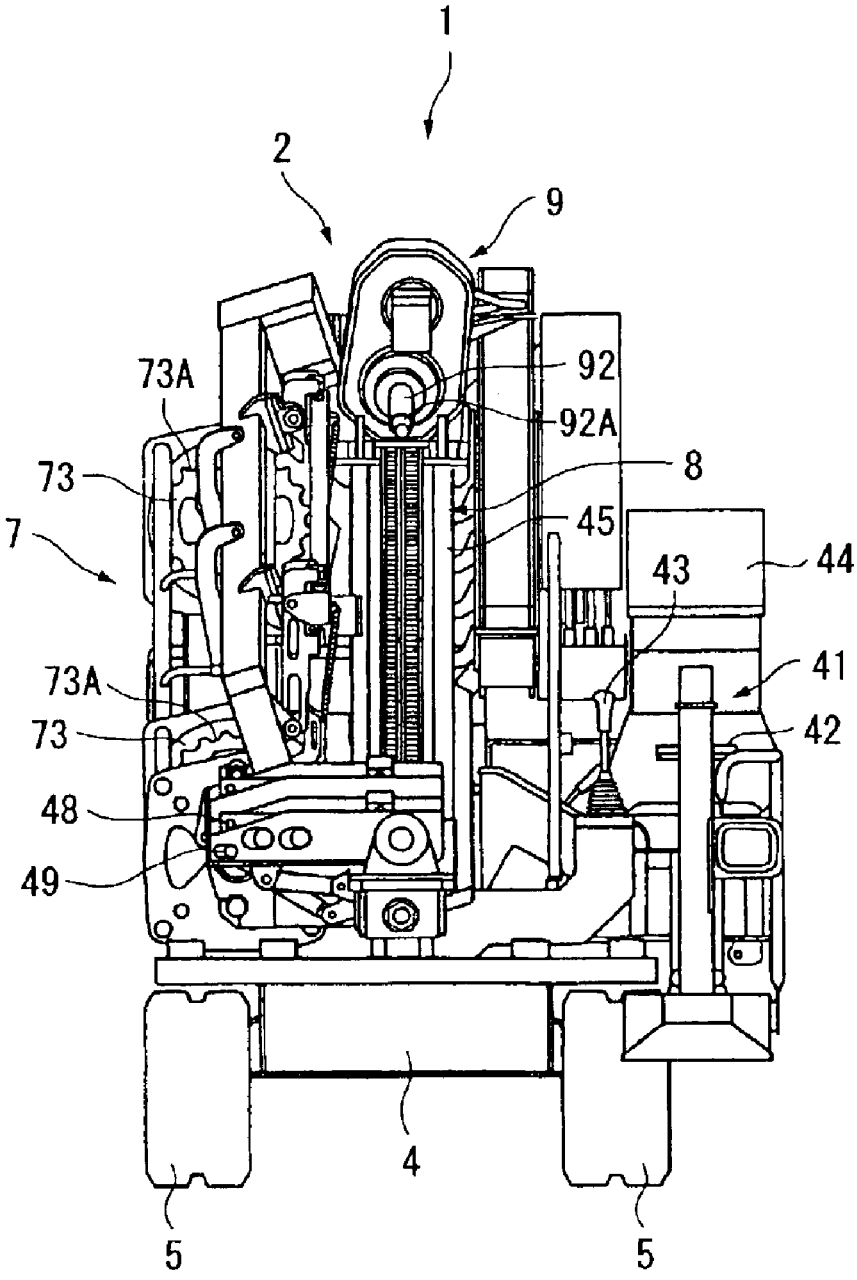
FIG. 1 is a schematic front view of the horizontal drill unit of the first embodiment of ground drilling machine according to the invention.
Figure 2:
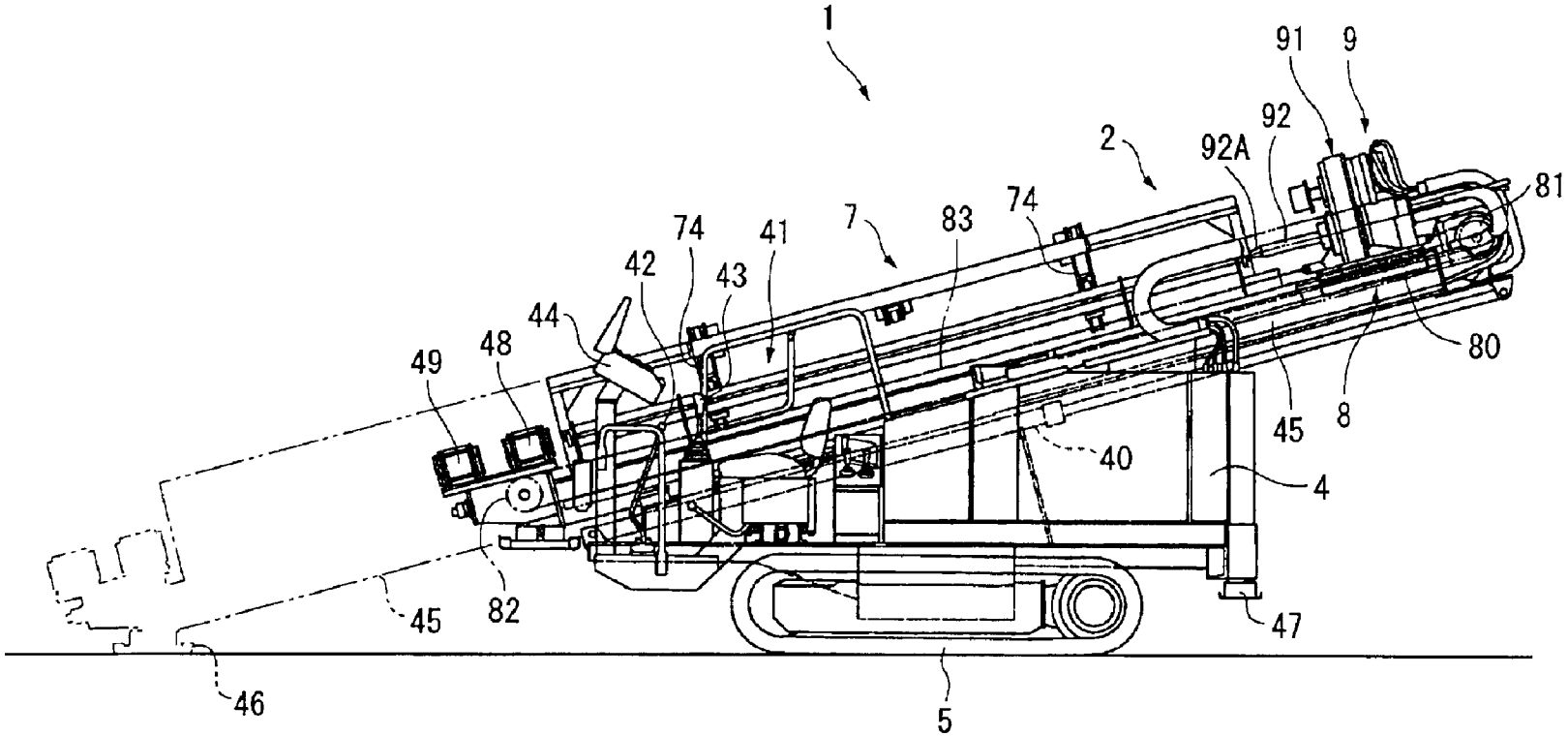
FIG. 2 is a schematic lateral view of the horizontal drill unit of FIG. 1.
Figure 3:
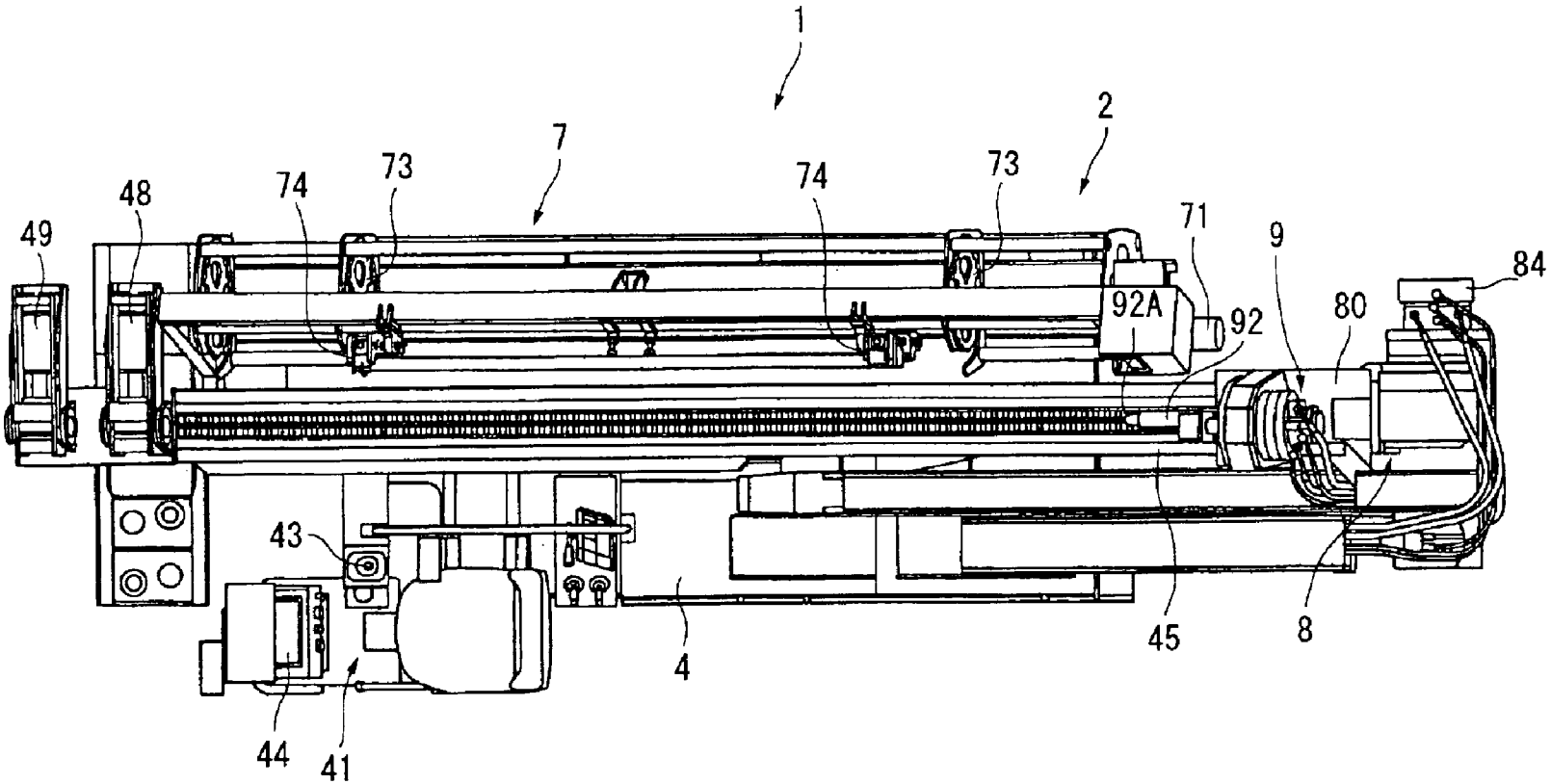
FIG. 3 is a schematic plan view of the horizontal drill unit of FIG. 1.
Figure 4:
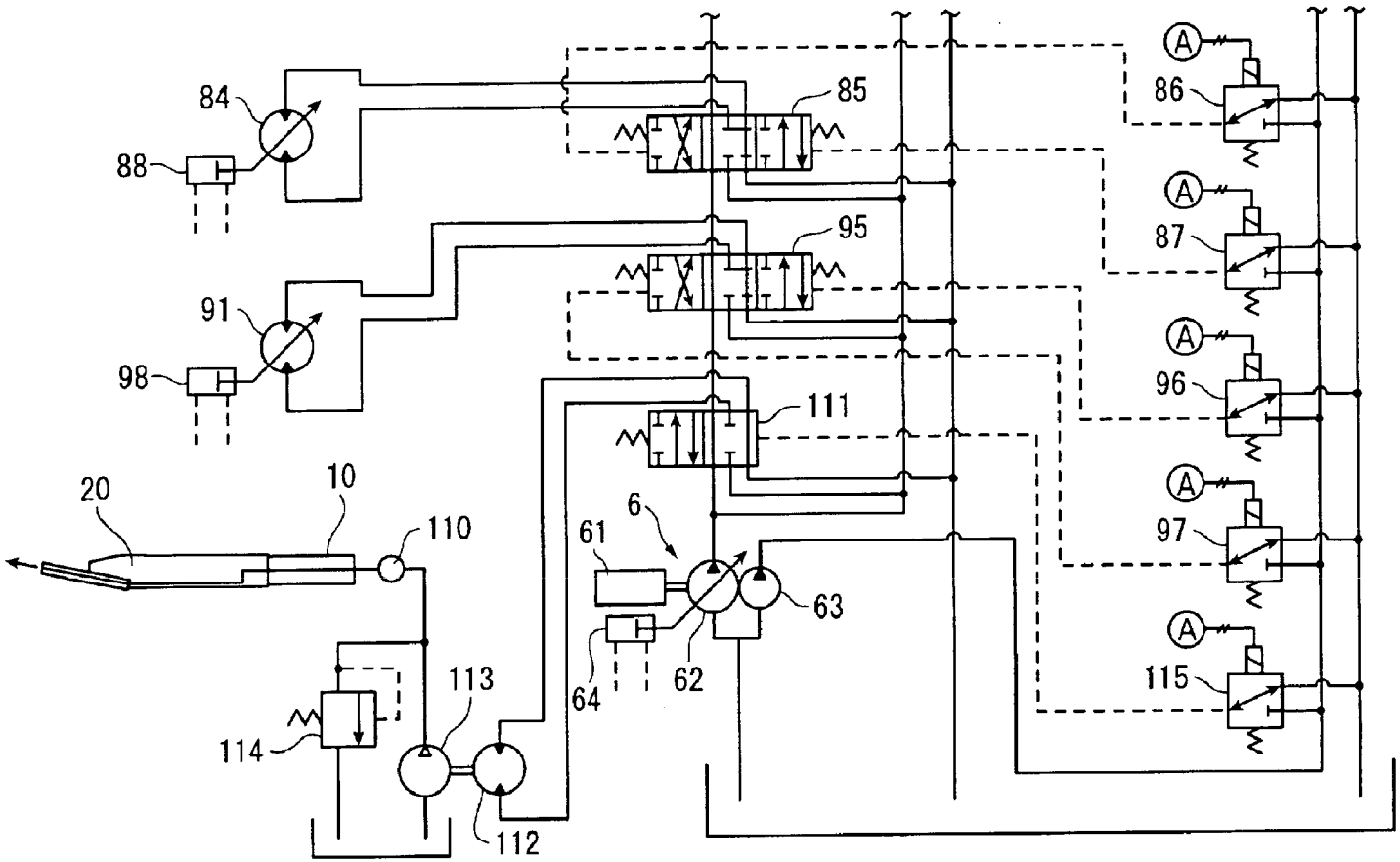
FIG. 4 is a schematic circuit diagram of the oil hydraulic circuit and the water hydraulic circuit that are used in the horizontal drill unit and the working liquid supply vehicle of the first embodiment.
Figure 5:
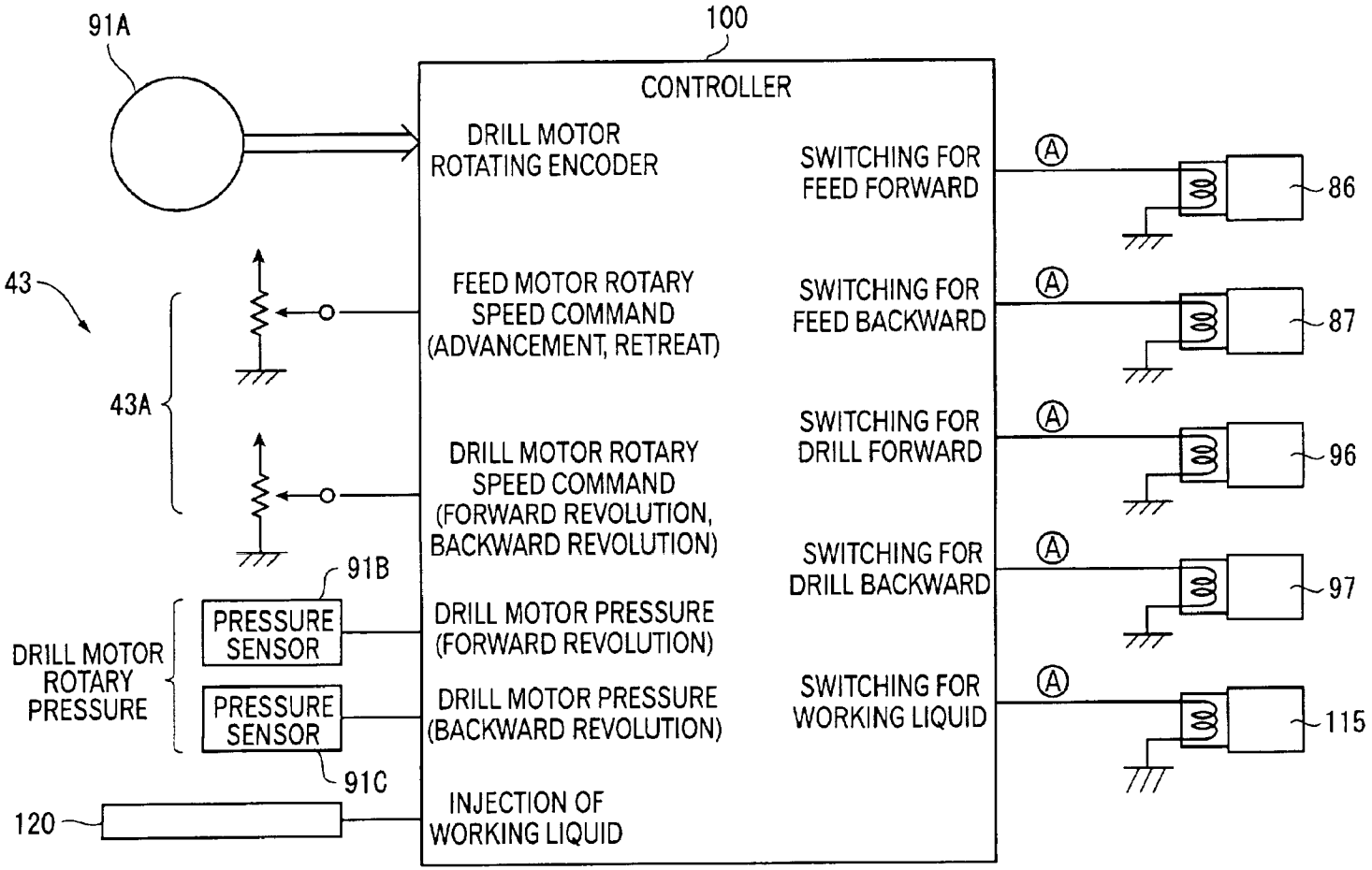
FIG. 5 is a schematic block diagram of a principal part of the horizontal drill unit of FIG. 1.

FIGS. 1, 2 and 3 are respectively a schematic front view, a schematic lateral view and a schematic plane view of the horizontal drill unit 2 of the first embodiment of ground drilling machine 1 according to the invention. FIG. 4 is a schematic circuit diagram of the oil hydraulic circuit and the water hydraulic circuit that are used in the horizontal drill unit 2 and working liquid supply vehicle 3. FIG. 5 is a schematic block diagram of a principal part of the horizontal drill unit 2.

Referring to FIGS. 1 through 5, the horizontal drill unit 2 comprises a vehicle body section 4 having a slope section at the top thereof, a pair of crawler type lower traveling bodies 5 arranged under the vehicle body section 4, a drive source 6 (FIG. 4) arranged inside the vehicle body section 4, a rod switching device 7 arranged on the vehicle body section 4 so as to be able to contain a plurality of rods 10 (FIGS. 13, 14), a rod propelling mechanism 8 for propelling the rod 10 fed from the rod switching device 7, a rod rotating mechanism 9 for rotating the rod 10 fed to the rod propelling mechanism 8 and a controller (flow rate control mechanism) 100 for automatically controlling the flow rate of working liquid being injected from a pilot head 20 (leading body), and for outputting an electric signal to the oil hydraulic circuit.

With the horizontal drill unit 2, a number of rods 10 drawn out of the rods contained in the rod switching device 7 are sequentially and linearly linked and driven forward by the rod propelling mechanism 8, while they are rotated by the rod rotating mechanism 9 so as to be able to dig a leading hole D by means of the pilot head 20 fitted to the front end of the rods 10 in a manner as described earlier by referring to FIGS. 13 and 14. Then, it is possible to replace the pilot head 20 by a reamer 30 in order to draw in the object of placement E and bury it in the ground. Now, each of the components of the horizontal drill unit 20 will be described below.

The vehicle body section 4 is provided with a cab 41 in which the operator can sit and operate the horizontal drill unit 2. The cab 41 is so designed that, whenever necessary, it can be moved sideways to shift the operator's sitting position. The cab 41 is provided with a travel lever 42 for maneuvering the lower traveling bodies 5 along with a joystick type operation lever 43 containing a potentiometer (rotating condition detection section, propelling condition detection section) 43A and a control panel 44 on which various indicators are arranged.

Figure 11:
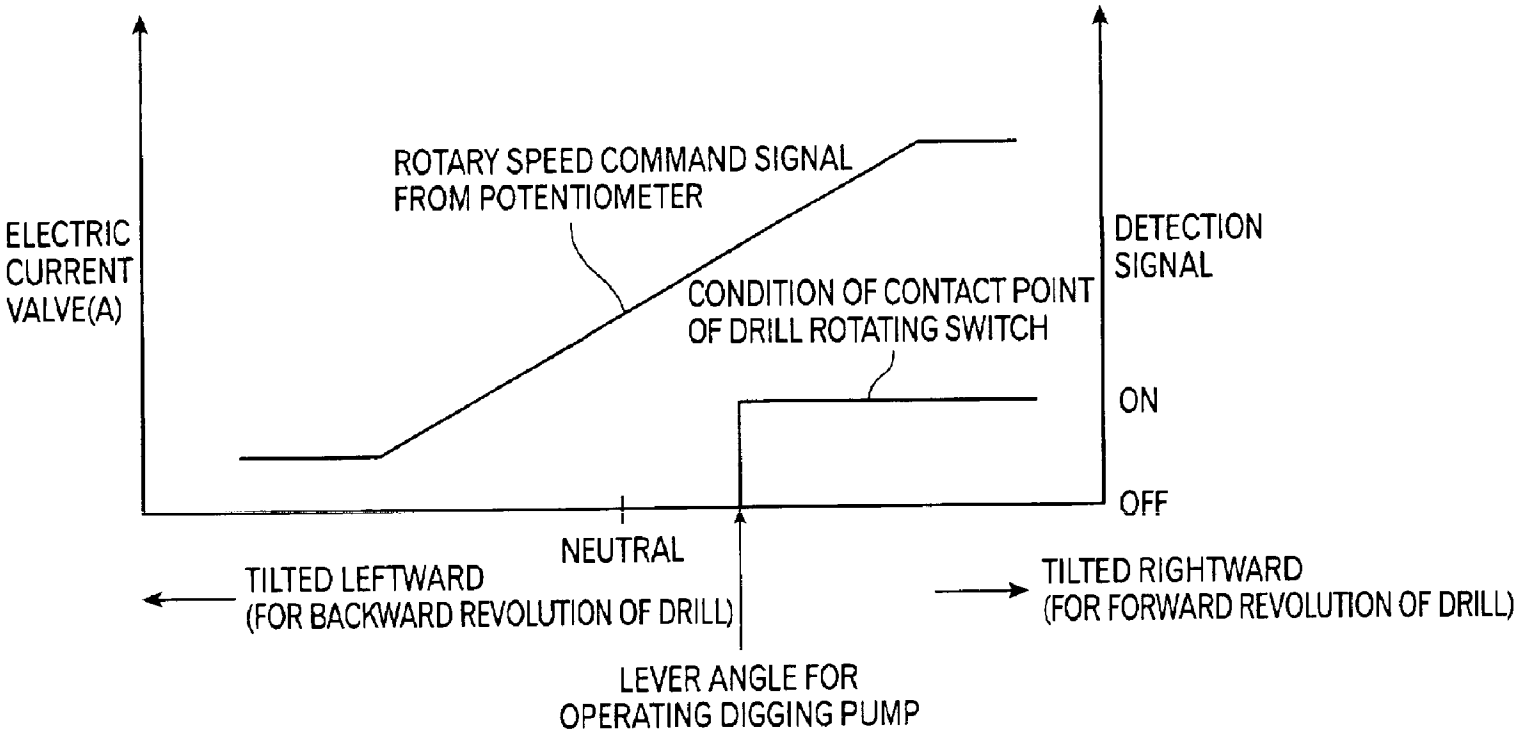
FIG. 11 is a graph illustrating the relationship between the tilted angle of the operation lever and the output signal.
Figure 12:
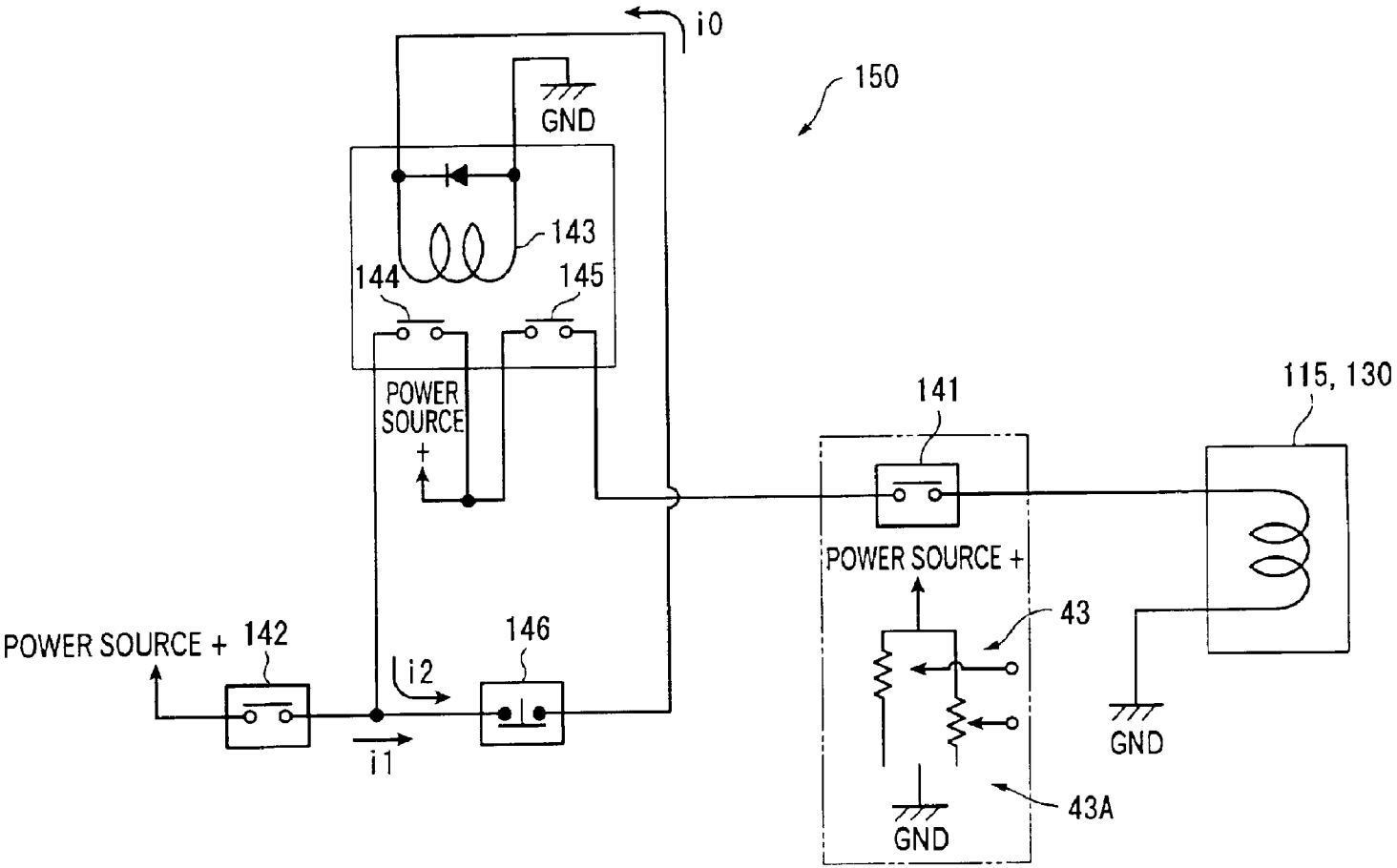
FIG. 12 is a schematic circuit diagram of the electric circuit for cutting off a positive flow of a modified embodiment of the invention.

FIG. 5 shows equivalent circuit diagrams of the potentiometer 43A of the operation lever 43. The equivalent circuit diagram shown in an upper half of FIG. 5 is applicable when the potentiometer 43A is made to operate as propelling condition detection section. Then, it outputs to the controller 100 a detection signal corresponding to the angle of forward/backward inclination of the operation lever 43 as forward/backward rotary speed command signal for the feed motor 84 (FIG. 4). The equivalent circuit diagram shown in a lower half of FIG. 5 is applicable when the potentiometer 43A is made to operate as rotating condition detection section. Then, it outputs to the controller 100 a detection signal corresponding to the angle of lateral inclination of the operation lever 43 as forward/backward rotary speed command signal (see also FIG. 11) for the drill motor 91 (FIG. 4).

The lower traveling bodies 5 are provided with respective hydraulic motors (not shown), which are driven by hydraulic pressure applied thereto from the drive source 6 by way of respective control valves. The lower traveling bodies 5 are not limited to the crawler type but may be of the tire type or of the tire/crawler combination type. While the horizontal drill unit 2 is described above as of the automotive type that is provided with lower traveling bodies 5, it may alternatively be of the trailer type that is to be pulled by the working liquid supply vehicle 3 or some other automotive vehicle for traveling.

As shown in FIG. 4, the drive source 6 comprises a diesel engine 61, a main hydraulic pump 62 and a pilot pressure generating pump 63, of which the main hydraulic pump 62 and the pilot pressure generating pump 63 are driven to operate by the diesel engine 61. The main hydraulic pump 64 is of the variable capacity type having a swash plate that is driven to operate by a cylinder 64, which is by turn driven to operate by the pilot pressure according to the command from the controller 100.

The rod switching device 7 is arranged integrally with and along the longitudinal direction of the frame 45 that is disposed on the vehicle body section 4. It has a rotary shaft to be driven to rotate by a hydraulic motor 71. A pair of disk-shaped rod holding plates 73 is fitted to the rotary shaft with a gap interposed between them in the longitudinal direction. Each of the rod holding plates 73 is provided with a number of arc-shaped recesses 73A along the outer periphery thereof so that each rod 10 is held in a pair of corresponding recesses of the front and rear rod holding plates 73. Note that rods 10 are not shown in FIGS. 1 through 3.

When a right one of the rods 10 held by the rod holding plates 73 is located at a predetermined position as a result of the rotary motion of the plates 73, it is released from the rod holding plates 73 as it is grasped by a swinging rod switching arm 74 and automatically fed toward the rod propelling mechanism 8. On the other hand, the rod 10 that is relieved out of service is released from the rod propelling mechanism 8 is grasped by the rod switching arm 74 and automatically returned to the rod switching device 7.

The frame 45 is mounted on the vehicle body section 4 in such a way that it is longitudinally movable along the inclined part of the vehicle body section 4 and its rear part is linked to a front area of the vehicle body section 4 by way of a moving cylinder 40. In FIG. 2, solid lines show the position of the moving cylinder 40 when it is extended. At this position, the frame 45 is entirely supported by the vehicle body section 4. On the other hand, as the moving cylinder 40 is retracted as shown by broken lines in FIG. 2, the frame 45 is moved forward along the inclined part until the anchor securing section 46 is grounded and the rod switching device 7 is held to the working position along with the rod propelling mechanism 8. The outrigger 47 arranged at a rear part of the vehicle body section 4 may be operated whenever necessary for a digging operation.

The rod propelling mechanism 8 is provided with a cradle 80 that is adapted to slide back and forth on the frame 45. A driving sprocket 81 and a following sprocket 82 are arranged respectively at the rear end and at the front end of the frame 45 and the opposite ends of the chain 83 that is wound around the sprockets 81, 82 is linked to the cradle 80. Thus, the rod 10 that is fed onto the frame 45 moves forward with the cradle 80 as the driving sprocket 81 is driven to rotate forwardly by the feed motor 84, whereas it moves backward as the driving sprocket 81 is driven to rotate backwardly.

As shown in FIG. 4, the feed motor 84 is an oil hydraulic motor and hence adapted to be driven back and forth under oil pressure applied by the main hydraulic pump 62 by way of a 6-port 3-position type feed transfer valve 85. The feed transfer valve 85 is switched by the pilot pressure applied to it from the pilot line by way of a feed forward proportional solenoid valve 86 or a feed backward proportional solenoid valve 87. The proportional solenoid valves 86, 87 supply pilot pressure that corresponds to the magnitude of the electric current signal output from the controller 100 to the feed transfer valve 85. Then, oil pressure corresponding to the pilot pressure is supplied to the feed motor 84 by way of the feed transfer valve 85 so that the rotary speed of the feed motor 84 can be regulated continuously. The feed motor 84 is of the variable capacity type having a swash plate whose angle of the inclination is switched by a cylinder 88. The rotary speed of the feed motor 84 can be shifted in two steps according to the command from the controller 100.

The rod rotating mechanism 9 is provided with a drill motor 91 fitted to the cradle 80. The revolutions of the drill motor 91 are output to the rotary shaft 92 by way of a reduction gear A screw section 92A is fitted to the front end of the rotary shaft 92 and is driven into the female screw section formed at the rear end of the rod 10 for engagement.

Like the above described feed motor 84, the drill motor 91 is also an oil hydraulic motor and driven back and forth by the oil pressure supplied to it by way of a drill revolution selector valve 95. The drill revolution selector valve 95 is also switched by the pilot pressure supplied to it from the proportional solenoid valve 96 for forward revolutions or from the proportional solenoid valve 97 for backward revolutions and oil pressure corresponding to the pilot pressure thereof is supplied from the drill revolution selector valve 95 to the drill motor 91 so that the rotary speed of the drill motor 91 can be regulated continuously. Additionally, since it is provided with a cylinder 98 for changing the angle of the swash plate, it is also adapted in such a way that its rotary speed can be shifted in two steps according to the command from the controller 100.

The controller 100 comprises a computer and is adapted to output an electric current signal having a given magnitude to the proportional solenoid valves 86, 87, 96, 97 according to the input signal given to it and control the rotary motion of the feed motor 84 and that of the drill motor 91. Input signals that can be given to the controller 100 include a drill motor driving encoder signal given from the encoder (rotary angle detection section) 91A arranged at the drill motor 91, a drill motor rotary speed command signal given from the above described operation lever 43, a feed motor rotary speed command signal also given from the operation lever 43, a drill motor pressure signal (for forward revolution) output from the pressure sensor 91B of the forward revolution side oil pressure supply line of the drill motor 91 and a drill motor pressure signal (for backward revolution) output from the pressure sensor 91C of the backward revolution side oil pressure supply line of the drill motor 91.

On the other hand, output signals that can be given by the controller 100 include electric current signals output to the proportional solenoid valves 86, 87, 96, 97 for drill forward revolution switching, drill backward revolution switching, feed forward switching and feed backward switching as well as electric current signals for switching the operation valves (not shown) to be used to supply pilot pressure to the cylinders 64, 88, 98 (FIG. 4) for changing the angles of the respective swash plates. Referring to FIG. 5, whenever necessary, the controller 100 receives a working liquid injection signal and outputs a working solution switching signal, which will be described hereinafter.

The horizontal drill unit 2 is provided at the front end of the frame 45 with a rod wrench 48 and a rod clamper 49, which are exclusively used to connect rods 10 and separate them from each other, although they are not described in detail here in terms of structure.

Now, the operations of propelling a rod 10, retracting a rod 10 and connecting a rod 10 to and disconnecting it from another will be described below.

As a succeeding rod 10 is supplied from the rod switching device 7 to the rod propelling mechanism 8 while the rear end of a preceding rod 10 is clamped by the rod clamper 49, the succeeding rod 10 is driven to advance with the cradle 80 of the rod propelling mechanism 8 and pushed against the rear end of the preceding rod 10. As the rotary shaft 92 of the rod rotating mechanism 9 is driven to rotate under this condition, the rotary shaft 92 is screwed into the rear end of the succeeding rod 10 so as to become engaged with the latter. Then, the succeeding rod 10 is also driven to rotate so that the male screw section 11 (FIG. 6) at the front end thereof is driven into the female screw section of the preceding rod 10 for mutual engagement. At this time, the feed transfer valve 85 is held to the central position (pump closed center) and the feed motor 84 revolves idly so that the cradle 80 is driven to advance by the distance by which the rotary shaft 92 and the succeeding rod 10 proceed by the rotary motion. As a result, the preceding rod 10 is coupled to the succeeding rod 10.

Thereafter, as the rod clamper 49 is loosened and the feed transfer valve 85 is switched to drive the feed motor 84 to revolve forwardly, the coupled rods 10 are driven to move forward by the rod propelling mechanism 8 for a digging operation. As the succeeding rod 10 comes to occupy the position of the preceding rod 10, its rear end is clamped by the rod damper 49 and the drill motor 91 is driven to revolve backwardly to release the rotary shaft 92. As a result, the cradle 80 is moved backward to its original position in order to wait for the supply of the next rod 10.

On the other hand, when the digging operation comes to an end and the succeeding rod 10 is released from the preceding rod 10, the cradle 80 is moved back to its rear position and the rear end of the preceding rod 10 is clamped by the rod damper 49 while the end of the succeeding rod 10 is held by the rod wrench 48 under the condition where the preceding rod 10 and the succeeding rod 10 are coupled together and the rotary shaft 92 is held in engagement with the rear end of the succeeding rod 10. Under this condition, the holding section of the rod wrench 48 is driven to rotate by means of a link mechanism using a cylinder in order to release the front end of the succeeding rod 10 from the rear end of the preceding rod and separate the two rods 10 from each other. At this time, the drill revolution selector valve 95 is held to the central position (pump closed center) and the drill motor 91 revolves idly due to the revolutions of the succeeding drill 10. Subsequently, the drill revolution selector valve 95 is switched to driven the drill motor 91 to revolve backwardly in order to release the succeeding rod 10 from the rotary shaft 91 while the front end of the succeeding rod 10 is held by the rod wrench 48. Finally, the succeeding rod 10 is returned from the rod propelling mechanism 8 by the rod switching device 7 and held at rest.

Now, the structure of the pilot head 20 of the drill and how the injection (flow rate) of the working liquid injected from the pilot head 20 is controlled will be described below.

Figure 6:
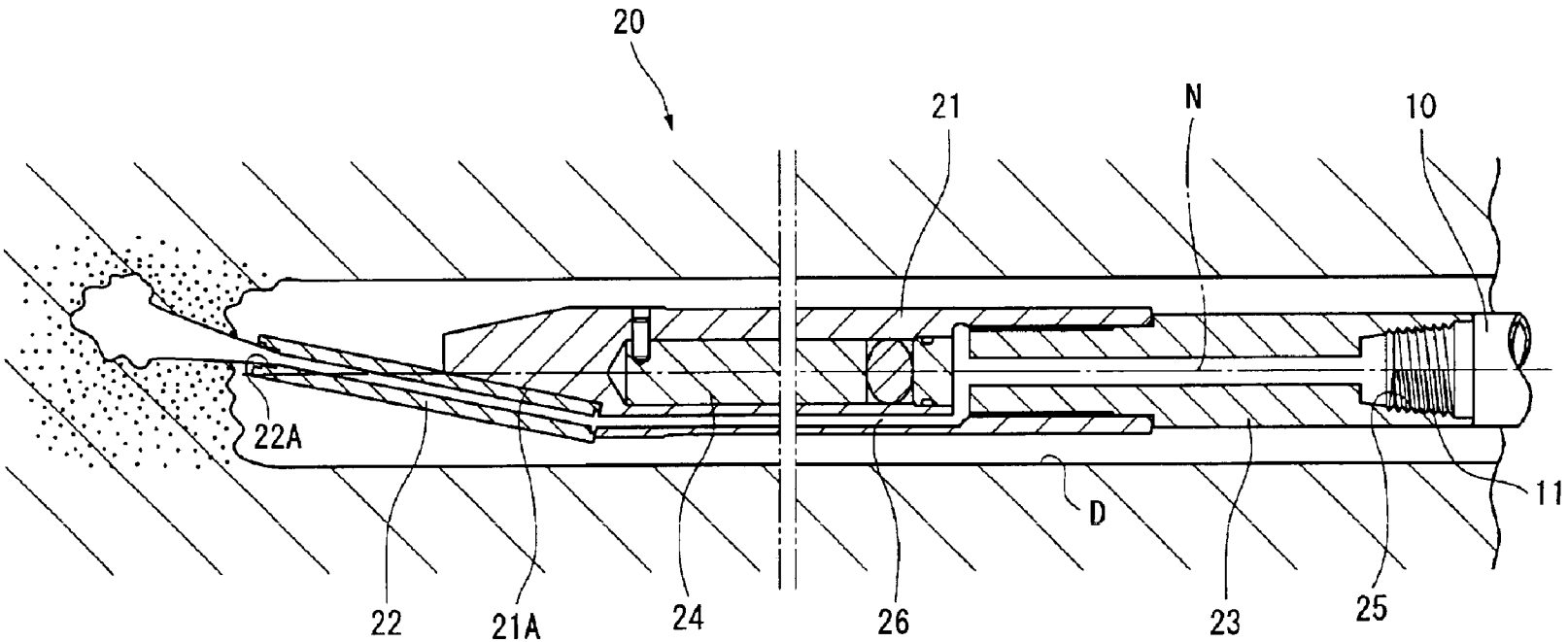
FIG. 6 is a schematic cross sectional view of the leading body of the horizontal drill unit of FIG. 1, which is a pilot head.
Figure 7:
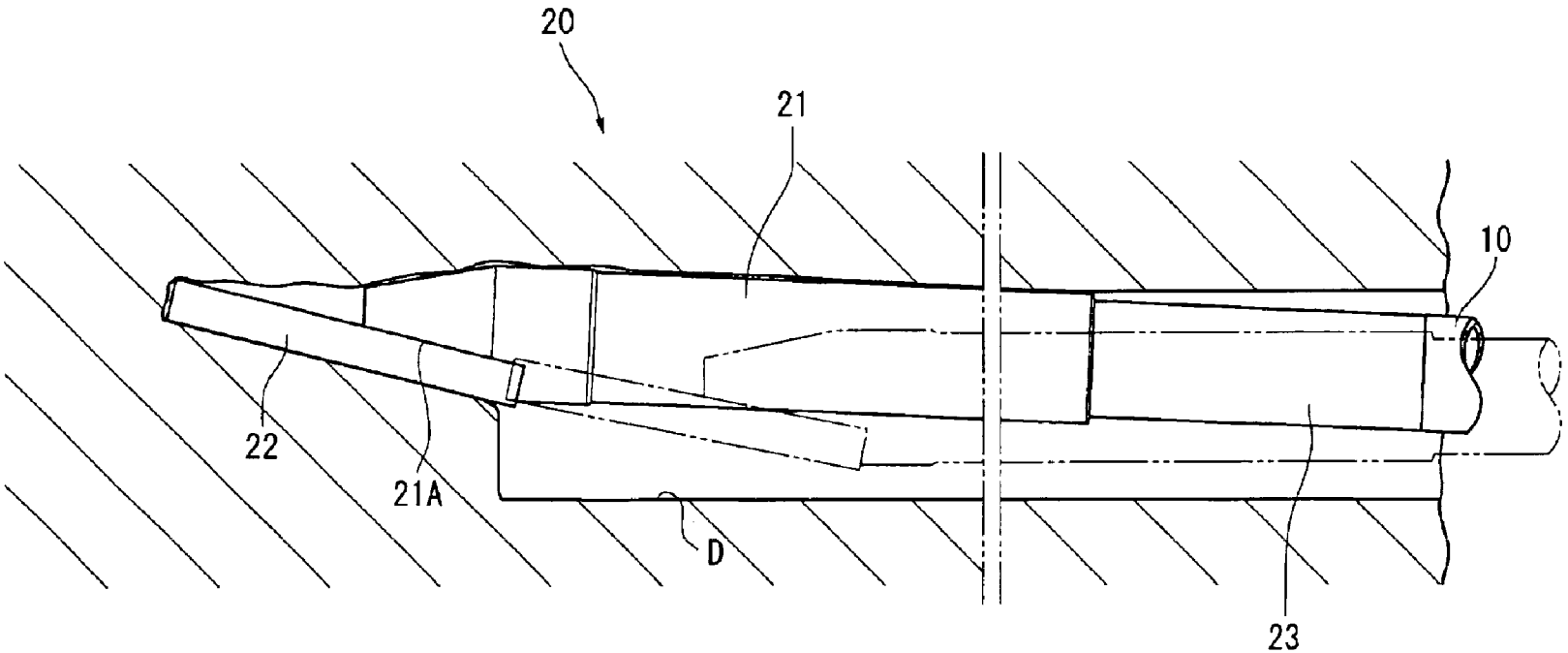
FIG. 7 is a schematic illustration of an operation of the pilot head of FIG. 6.

Referring to FIGS. 6 and 7, the pilot head 20 comprises a hollow head main body 21, a slant-cutting section 22 formed at the front end of the head main body 21 and a coupling section 23 screwed into the rear end of the head main body 21.

A transmitter (sonde) 24 is contained in the head main body 21 so that the pilot head 20 can be detected to find out its position and the depth from the ground surface by detecting the direction and the intensity of the magnetic field generated by the transmitter 24 by means of a magnetism detector on the ground. Additionally, it is also possible to detect the angle of inclination of the pilot head 20 relative to a horizontal and the direction (rotary angle) of the slant-cutting section 22 by way of the magnetic communication from the transmitter 24 to the magnetism detector. The front end of the head main body 21 is made to show a frusto-conical profile and a flat and sloped surface section 21A that is inclined toward the front end of the axis of the head main body 21 is formed at a part of the frustum of cone.

The slant-cutting section 22 is formed by using a rectangular plate member that is rigidly secured to the sloped surface section 21A of the head main body 21 by bolts. It is extended forwardly further from the front end of the head main body 21. Due to the provision of the slant-cutting section 22, the inner diameter of the leading hole D dug by the rotary motion of the pilot head 20 is made slightly greater than the outer diameter of the head main body 21 and a gap is produced between the leading hole D and the pilot head 20 for allowing the soil produced by digging to flow backward with working liquid. When the pilot head 20 is forced to move forward without rotating, the slope of the slant-cutting section 22 is subjected to reaction force and hence the moving direction of the pilot head 20 is shifted to make it move along the slope. For instance, if the slant-cutting section 22 takes the position shown in FIG. 7, the pilot head 20 is forced to advance gradually upwardly as it moves forward.

A tapered female screw section 25 is formed at the rear end of the coupling section 23 and the male screw 11 arranged at the front end of the rod 10 is driven into it for mutual engagement.

The pilot head 20 is provided in the inside thereof with a working liquid flow path 26 that runs through the head main body 21, the slant-cutting section 22 and the coupling section 23. Thus, working liquid firstly flows through the hollow section in the inside of the rod 10 and goes into the pilot head 20 by way of the female screw section 25 and then it flows through the working liquid flow path 26 before it is injected via the injection port 22A at the front end of the slant-cutting section 22. Working liquid is injected substantially in the running direction of the slant-cutting section 22 which is offset from the axis of rotation N of the pilot head 20. Working liquid is supplied from the working liquid supply vehicle 3 to the rod 10 by way of the rotary shaft 92 of the reduction gear that is driven by the drill motor 91. Therefore, as schematically illustrated in FIG. 4, the related part of the reduction gear is connected to a water hydraulic circuit by way of a swivel joint 110.

Referring to FIG. 4, the oil pressure applied from the main oil hydraulic pump 62 is then transferred to working liquid motor 112 by way of a working liquid transfer valve 111. The working liquid pump 113 is driven by the working liquid motor 112 to pump up working liquid from the working liquid tank and feed it to the drill (the rod 10, the pilot head 20). The relief valve 114 of the water hydraulic circuit is adapted to operate when working liquid is not fed properly because the injection port 22A is clogged by dug soil or for some other reason. The working liquid transfer valve 111 is switched by pilot pressure applied from the proportional solenoid valve 115. The proportional solenoid valve 115 is adapted to supply pilot pressure that corresponds to the magnitude of the electric current signal for switching the supply of working liquid output from the controller 100 (FIG. 5) to the working liquid transfer valve 111.

While a proportional solenoid valve 115 is used for switching the working liquid transfer valve 111 in this embodiment, it may be replaced by an ordinary change-over valve. Additionally, which part of the oil hydraulic circuit and which part of the water hydraulic circuit of FIG. 4 are arranged at the side of the horizontal drill unit 2 and which parts are arranged at the side of the working liquid supply vehicle 3 may be determined on an on-site basis.

Thus, a leading hole D is dug by propelling the pilot head 20. When the pilot head 20 is to be driven straight ahead, it is operated to revolve and working liquid is injected forward as shown in FIG. 6. When changing the direction of propelling the pilot head 20, the pilot head 20 is not driven to revolve but simply propelled forward and working liquid is not injected either. In this way, working liquid is injected under control depending on if the pilot head 20 is revolving or not and how it is being propelled in this embodiment. Now, how the embodiment is controlled will be described below by referring to FIG. 8.

(forward revolution of drill+advancement of drill=injection of working liquid)

Referring to FIG. 8, working liquid is injected from the pilot head 20 when the drill is driven to advance by the rod propelling mechanism 8 while it is made to revolve forward by the rod rotating mechanism 9.

This mode of operation is mainly used for digging a leading hole D straight forward by means of the pilot head 20. This controller 100 recognizes this mode of operation by way of a drill motor rotary speed command signal (for forward revolution) output when the operation lever 43 is tilted rightward in FIG. 5 and a feed motor rotary speed command signal (for advancement) output when the operation lever 43 is tilted forward. Upon recognizing the mode of operation, the controller 100 outputs an electric current for selecting forward revolution of the drill and also an electric current for selecting forward feeding respectively to the proportional solenoid valves 86, 96 to switch the feed transfer valve 85 and the drill revolution selector valve 95 in order to drive the feed motor 84 and the drill motor 91. Additionally, the controller 100 outputs a working liquid switching electric current signal to the proportional solenoid valve 115 to switch the working liquid transfer valve 111 in order to drive the working liquid pump 113 for the purpose of supplying and injecting working liquid.

Since the drill motor 91 is driven to revolve forward and a drill motor pressure signal (for forward revolution) is output from the pressure sensor 91B in this mode of operation, the controller 100 may output either a working liquid switching electric current signal along with this signal as trigger, or only a working liquid switching electric current signal, using this signal only as trigger.

(forward revolution of drill+retreat of drill+injection of working liquid)

This mode of operation is used typically for replacing the pilot head 20 with the reamer 30 to broaden the diameter of the leading hole D. More specifically, the pilot head 20 is retracted by means of the rod propelling mechanism 8, while the reamer 30 is driven to revolve forward by means of the rod rotating mechanism 9, and working liquid is injected from the reamer 30.

The controller 100 recognizes this mode of operation by way of a drill motor rotary speed command signal (for forward revolution) output when the operation lever 43 is tilted rightward in FIG. 5 and a feed motor rotary speed command signal (for retreat) output when the operation lever 43 is tilted backward. Upon recognizing the mode of operation, the controller 100 outputs an electric current for selecting forward revolution of the drill and also an electric current for selecting backward feeding respectively to the proportional solenoid valves 86, 96 in order to drive the feed motor 84 and the drill motor 91. Additionally, the controller 100 outputs a working liquid switching electric current signal to the proportional solenoid valve 115 for the purpose of supplying and injecting working liquid through the reamer 30.

Since the drill motor 91 is driven to revolve forward and a drill motor pressure signal (for forward revolution) is output from the pressure sensor 91B in this mode of operation too, the controller 100 may output either a working liquid switching electric current signal along with this signal as trigger, or only a working liquid switching electric current signal, using this signal only as trigger.

(forward revolution of drill+stop of propelling drill=stop of injection of working liquid)

In a mode of operation where the drill is driven to revolve forward but propelling the drill is stopped, the injection of working liquid is stopped.

This mode of operation is used typically for coupling rods 10 in order to dig a leading hole D or for idly rotating the pilot head 20 to regulate the position of the slant-cutting section 22 in order to change the moving direction of the pilot head 20. The controller 100 recognizes this mode of operation when only a drill motor rotary speed command signal (for forward revolution) is output as a result of that the operation lever 43 is tilted rightward in FIG. 5. Alternatively, it may be so arranged that the controller 100 recognizes this mode of operation on the basis of a drill motor pressure signal (for forward revolution) from the pressure sensor 91B. When the controller 100 recognizes the mode of operation, it does not output a working liquid switching electric current signal so that no working liquid is injected.

The position of the slant-cutting section 22 is regulated in a manner as described below. Firstly, the current position of the slant-cutting section 22 is detected by way of magnetic communication from the transmitter 24 in the pilot head 20 to the magnetism detector. Then, the angle by which the pilot head 20 is rotated in order to move the slant-cutting section 22 to the right position for the direction in which it is propelled is conformed before actually changing the direction in which the slant-cutting section 22 is propelled. Thereafter, the pilot head 20 is actually rotated by that angle. The extent to which the pilot head 20 is rotated is controlled by means of a drill motor rotating encoder signal from the encoder 91A shown in FIG. 5.

(backward revolution of drill+stop of propelling drill=stop of injection of working liquid)

In a mode of operation where the drill is driven to revolve backward but propelling the drill is stopped, the injection of working liquid is also stopped.

This mode of operation is used typically for releasing the succeeding rod 10 from the preceding rod 10 in order to draw in the object of placement E. The controller 100 recognizes this mode of operation when only a drill motor rotary speed command signal (for backward revolution) is output as a result of that the operation lever 43 is tilted leftward in FIG. 5. Alternatively, it may be so arranged that the controller 100 recognizes this mode of operation on the basis of a drill motor pressure signal (for backward revolution) from the pressure sensor 91C.

Because the succeeding rod 10 is driven to rotate forward so as to be screwed into the preceding rod 10 for coupling in this embodiment, it is so controlled that neither of them are driven backward except when they are to be separated from each other. Therefore, there are neither a mode of operation of backward revolution of the drill+advancement of the drill nor a mode of operation of backward revolution of the drill+retreat of the drill for digging the ground. However, if the rods 10 are not coupled by screwing but by using key seats, it is conceivable that the drill is made to advance in order to dig a leading hole D or enlarging its diameter while the pilot head 20 or the reamer 30 is driven to revolve backward. Then, working liquid may be injected in such a case.

(stop of revolution of drill+advancement of drill=stop of injection of working liquid)

The injection of working liquid is stopped when the revolution of the drill is stopped while the drill is driven to advance.

This mode of operation is used to drive the pilot head 20 to advance while the direction in which it is propelled is being changed. Therefore, the controller 100 recognizes this mode of operation because no drill motor rotary speed command signal is output but only a feed motor rotary speed command signal (for advancement) is output from the operation lever 43. When the controller 100 recognizes this mode of operation, it does not cause any working liquid to be injected.

(stop of revolution of drill+retreat of drill=stop of injection of working liquid)

The injection of working liquid is stopped when the revolution of the drill is stopped while the drill is driven to retreat.

This mode of operation is used typically to drive the pilot head 20 to retreat so as to be collected (and hence the reamer 30 is not operated to enlarge the hole diameter). Therefore, the controller 100 recognizes this mode of operation because no drill motor rotary speed command signal is output but only a feed motor rotary speed command signal (for retreat) is output from the operation lever 43. When the controller 100 recognizes this mode of operation, it does not cause any working liquid to be injected.

(stop of revolution of drill+stop of propelling drill=stop of injection of working liquid)

The injection of working liquid is stopped when both the revolution and the propelling of the drill are stopped.

No digging operation is conducted in this mode of operation. Therefore, the controller 100 recognizes this mode of operation because neither drill motor rotary speed command signal nor feed motor rotary speed command signal are output from the operation lever 43.

In the modes of operation of the drill as shown in FIG. 8 in terms of revolution and propelling, basically no working liquid is injected when the drill is in any of the shaded states. However, for example, when both the revolution and the propelling of the drill are stopped, there may be a situation where it is desirable to eject working liquid in order to remove the dug soil clogging the injection port 22A of the pilot head 20, to see if working liquid is being reliably injected or for some other reason. If such is the case, the automatic control of injection of working liquid by the controller 100 can be suspended to manually inject or eject working liquid by depressing the manual working liquid operation switch 120 shown in FIG. 5.

The above described embodiment provides the following advantages.

(1) Since the horizontal drill unit 2 of the ground drilling machine 1 is provided with an operation lever 43 for driving the pilot head 20 or the reamer 30 to revolve and a controller 100 for automatically controlling the injection of working liquid according to the drill motor rotary speed command signal output from the potentiometer 43A on the basis of the rotary condition of the pilot head 20 or the reamer 30, it is possible to switch the working liquid transfer valve 111 so as to inject working liquid in order to improve the digging efficiency, the soil delivering efficiency and/or the cooling efficiency when the pilot head 20 or the reamer 30 is revolving even if the pilot head 20 is advancing or retreating.

Additionally, when the operation of the pilot head 20 is stopped in order to change or correct the direction of propulsion, it is not necessary to use working liquid to deliver dug soil or cool the leading body so that the injection of working liquid can be stopped. Therefore, working liquid can be injected at an optimal rate depending on the rotary condition of the pilot head 20 or the reamer 30 to eliminate any waste of working liquid and reduce the operation cost.

(2) The controller 100 can accurately detect if the pilot head 20 or the reamer 30 is advancing or not on the basis of the feed motor rotary speed command signal from the potentiometer 43A. Thus, it can reliably recognize the state where the pilot head 20 or the reamer 30 is not revolving and hence the rod 10 may be being fitted in position or removed so that no digging operation is being conducted. Then, the controller 100 stops the injection of working liquid in such a state to further eliminate any waste of working liquid.

(3) The controller 100 completely stops the injection of working liquid when the pilot head 20 is made to advance while its revolution is stopped so as to dig soil while changing the direction of propelling the pilot head 20. Therefore, the ground is prevented from loosening and reaction force is easily exerted on the pilot head 20. Thus, the direction of propelling the pilot head 20 can be changed with a reduced radius of curvature so that the digging length L from the entrance pit A to the starting pit B can be reduced to improve the efficiency of digging operation. Additionally, when the direction of propelling the pilot head 20 needs to be shifted in order to avoid an obstacle between the starting pit B and the destination pit C, again the direction of propelling the pilot head 20 can be changed with a reduced radius of curvature so that the pilot head 20 can easily return to its proper linear track. In other words, the digging operation can be conducted with an enhanced degree of freedom in terms of changing the direction of propelling the pilot head 20.

(4) Since the horizontal drill unit 2 is provided with a manual working liquid switch 120 for suspending the automatic control of injection of working liquid to allow the operator to manually inject working liquid, it is possible to eject working liquid by using the manual working liquid switch 120 in order to remove the dug soil clogging the injection port 22A of the pilot head 20, to see if working liquid is being reliably injected or for some other purpose, although working liquid is prevented from being injected when the automatic control is in effect and the pilot head 20 is being not used for a digging operation. Thus, the operability of the horizontal drill unit 2 is greatly improved.

(5) Since a drill motor pressure signal is output to the controller 100 from the pressure sensors 91B, 91C detecting the oil pressure being applied to the drill motor 91, the rotary condition of the drill motor 91 can be judged not only on the basis of the drill motor rotary speed command signal from the potentiometer 43A but also on the basis of the drill motor pressure signal to improve the accuracy of judgment of the rotary condition. Additionally, since the drill motor signal (for forward revolution) and the drill motor signal (for backward revolution) are output as separate detection signals, it is possible to accurately judge if the drill motor 91 is revolving forwardly or backwardly on the basis of these signals.

[2nd Embodiment]

Figure 9:
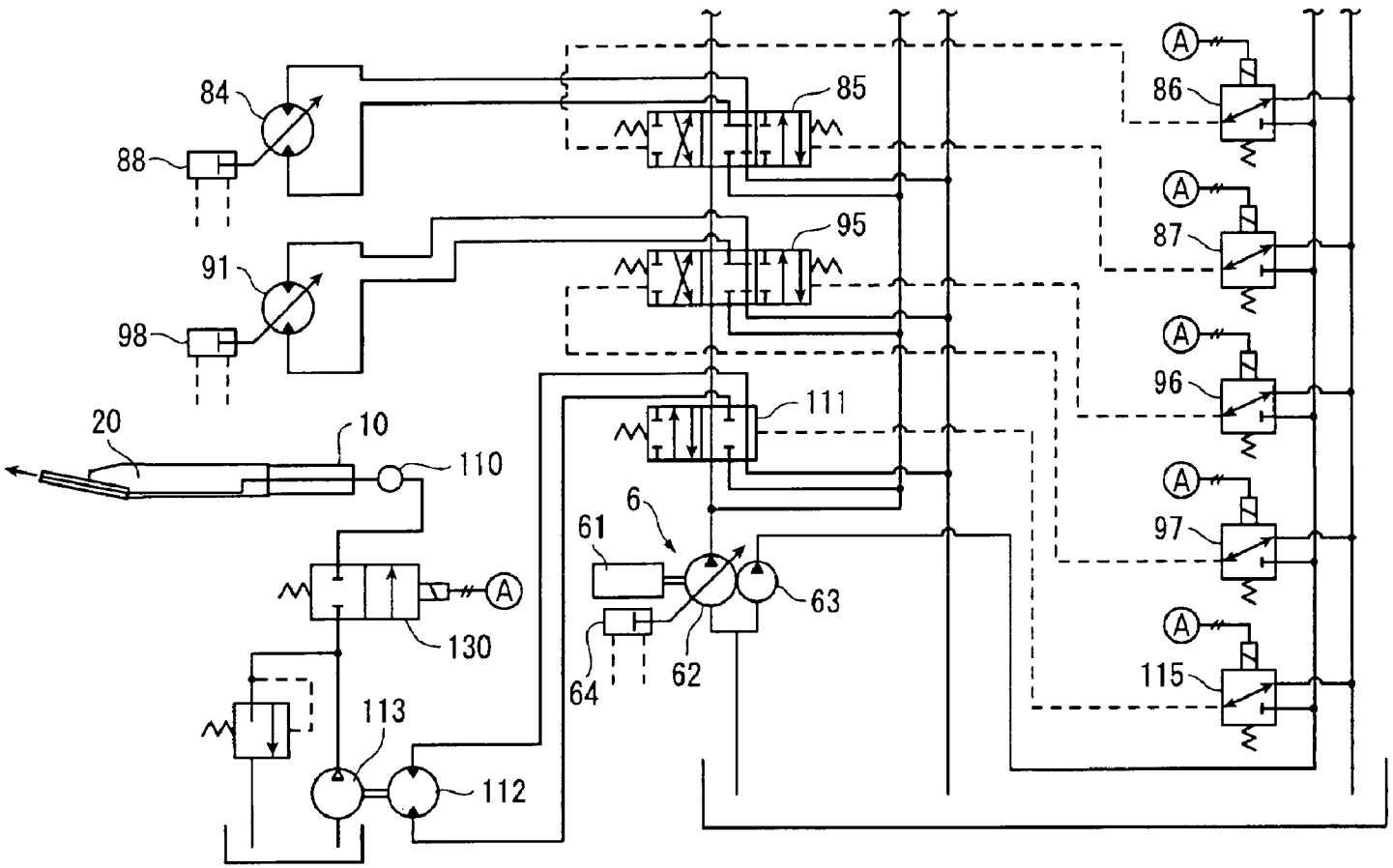
FIG. 9 is a schematic circuit diagram of the oil hydraulic circuit and the water hydraulic circuit that are used in the horizontal drill unit and the working liquid supply vehicle of the second embodiment of the invention.

FIG. 9 schematically illustrates the second embodiment of the invention.

This embodiment differs from the first embodiment in that a changeover valve 130 is provided on the working liquid flow path between the working liquid pump 113 and the rod 10 (drill). This changeover valve 130 is switched by a switch signal from the controller 100 (FIG. 5) and, since it is located at a position close to the drill, it is possible to suspend the supply of working liquid while driving the working liquid motor 112 and the working liquid pump 113 to operate and also control the injection of working liquid from the pilot head 20.

Specifically, in terms of control, the controller 100 monitors the drill motor driving encoder signal from the encoder 91A as detection signal and outputs a switch signal to the changeover valve 130 and allows the pilot head 20 to inject working liquid only when it judges that the extent of revolution (rotary angle) of the pilot head 20 that is adapted to revolve 360° is found within a predetermined angular range. Therefore, the pilot head 20 alternately injects working liquid and stops the injection while it makes a full turn.

The above described embodiment provides the following advantages.

(6) Since the pilot head 20 injects working liquid only when the rotary angle of the revolving pilot head 20 is found within a predetermined angular range, the ground can be loosened only in a given direction at the front end side of the leading hole D and the direction of propelling the pilot head 20 can be easily shifted toward the loosened part of the ground. Therefore, the pilot head 20 can be driven to revolve and dig the ground while the direction of propelling it is being shifted so as to remarkably improve the digging efficiency. Additionally, since working liquid is injected only when the rotary angle of the pilot head 20 is found within a predetermined angular range, the rate of consumption of working liquid is reduced and the above described advantage (1) is not damaged.

(7) Since the changeover valve 130 is arranged downstream relative to the working liquid pump 113 and can be switched while the working liquid motor 112 and the working liquid pump 113 are being driven to operate, the injection of working liquid from the pilot head 20 and the suspension of injection can be realized instantaneously with a quick responsiveness without being influenced by the inertia of the working liquid motor 112 and that of the working liquid pump 113 so that the operation of injecting working liquid can be conducted with a very quick responsiveness if compared with the arrangement of switching the proportional solenoid valve 115 for alternate injection and suspension of injection of working liquid.

The changeover valve 130 of this embodiment may be replaced with a proportional control valve.

The changeover valve 130 may be used if the above described control operation of allowing the pilot head 20 to inject working liquid only when its rotary angle is found within a predetermined angular range is omitted from this embodiment. If such is the case, the injection of working liquid can be controlled both at the water hydraulic circuit side and at the oil hydraulic circuit side so that the control operation can be conducted in different ways.

[3rd Embodiment]

Figure 10:
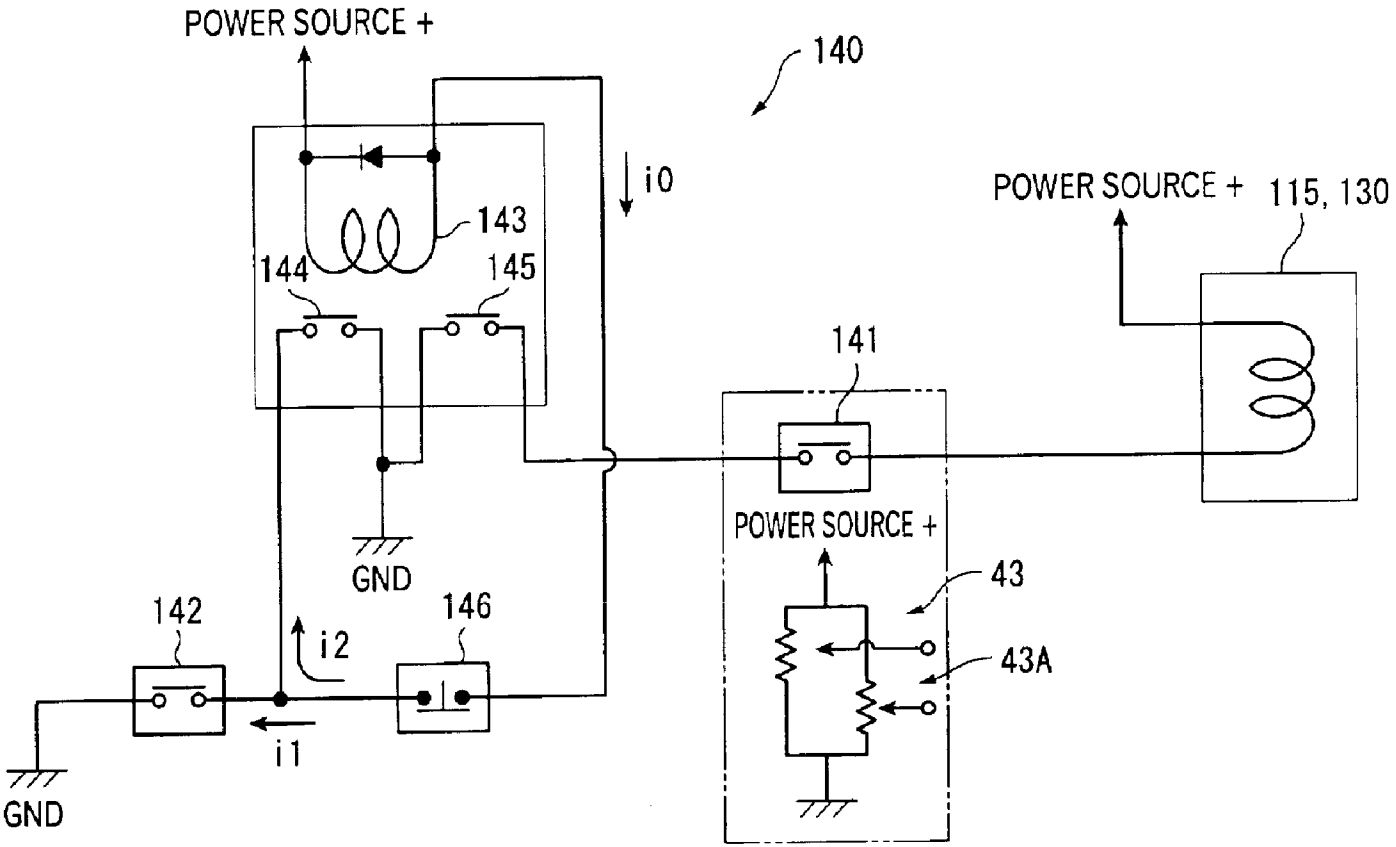
FIG. 10 is a schematic circuit diagram of the electric circuit for cutting off a negative flow of the third embodiment of the invention.

FIG. 10 is a schematic circuit diagram of the electric circuit for cutting off a negative flow (flow rate control mechanism) 140 according to the third embodiment of the invention.

While the controller 100 outputs a working liquid switching electric current signal to the proportional solenoid valve 115 on the basis of the drill motor rotary speed command signal output from the potentiometer 43A of the operation lever 43, the proportional solenoid valve 115 or the changeover valve 130 of this embodiment is switched automatically when the drill rotating switch 141 that is interlocked with the forward movement of the operation lever 43 is turned "ON". More specifically, the drill rotating switch 141 is turned "ON" by the detection signal from the potentiometer 43A when the operation lever 43 is tilted rightward in FIG. 11 from the neutral position by more than a predetermined angle.

This operation will be described by referring to the circuit diagram of the electric circuit. Firstly, as the switch 142 for activating the working liquid pump is turned "ON", electric currents i0, i1 are made to flow to excite the exciting coil 143 and close the contact points 144, 145. Since the contact points 144, 145 are grounded, another electric current i2 also flows in addition to the electric currents i0, i1. Therefore, although the switch 142 for activating the working liquid pump is a momentary switch that closes the contact point when it is depressed by hand and opens the contact point when the hand depressing the switch is released, the excited state of the exciting coil 143 is maintained by the electric currents i0, i2. As the operation lever 43 is tilted forward under this condition, the drill rotating switch 141 is turned "ON" and the proportional solenoid valve 115 or the changeover valve 130 is excited to operate the working liquid pump 113 (FIGS. 4, 9).

On the other hand, when the operation lever 43 is returned to the neutral position and the drill rotating switch 141 is turned "OFF" or the working liquid pump deactivating switch 146 is turned "ON" to open the contact point, the excited state of the proportional solenoid valve 115 or the changeover valve 130 is released and the working liquid pump 113 is deactivated to stop the injection of working liquid.

This embodiment provides the advantage (8) as described below.

(8) Since the proportional solenoid valve 115 or the changeover valve 130 is switched not by an output from the controller 100 comprising a computer but the "ON" or "OFF" state of the drill rotating switch 141 that is interlocked with the operation of the operation lever 43 so that the controller 100 can be omitted when an electric circuit 140 electrically connecting the drill rotating switch 141, the proportional solenoid valve 115, the changeover switch 130 and other related electric components is formed. Therefore, the manufacturing cost can be reduced.

The present invention is by no means limited to the above described embodiments, which may be modified or altered in many different ways, and may be embodied in many other different ways without departing from the spirit and scope of the invention.

For example, the electric circuit for cutting off a negative flow is used to switch the proportional solenoid valve 115 or the changeover valve 130 in the third embodiment, it may be replaced with an electric circuit for cutting off a positive flow (flow rate control mechanism) 150 by changing the electric connection of the power source. With such an electric circuit, the electric currents i0, i1, i2 flow in respective directions opposite to those of the third embodiment but the net effect is same as that of the third embodiment to also provide the above described advantage (8).

Additionally, the present invention is not limited to cause the pilot head 20 to inject working liquid or stop the injection of working liquid in order to control the flow rate of injected working liquid. Alternatively, the flow rate of working liquid may be controlled, reducing the rate of injection of working liquid.

In each of the above described embodiments, the injection of working liquid and the stop of injecting working liquid are controlled by relying on if the drill motor 91 is revolving or stopped. However, the flow rate of injected working liquid may alternatively be controlled as a function of the rotary speed of the drill motor 91. For example, it may be so arranged that working liquid is injected when the rotary speed of the drill motor 91 exceeds a certain threshold value and no working liquid is injected so long as the rotary speed of the drill motor 91 does not get to the threshold value.

While the potentiometer 43A operates both as rotating condition detection section and as propelling condition detection section in the first and second embodiments, pressure sensors 91B, 91C as shown in FIG. 5 may alternatively be used as rotating condition detection section. Still alternatively, a revolution sensor that can detect the revolution of the drill motor 91 or the rotary shaft 92 may be used.

An oil pressure sensor adapted to detect the oil pressure being applied to the feed motor 84 or a revolution sensor adapted to detect the revolution of the feed motor 84 may be used as propelling condition detection section. In short, any sensors that can directly or indirectly detect the rotating condition and the propelling condition of the pilot head 20 or the reamer 30 may be used as rotating condition detection section and propelling condition detection section for the purpose of the invention.

Finally, the encoder 91A may be replaced by sensor that can detect the rotary angle of the drill motor 91 or that of the rotary shaft 92 as rotary angle detection section for the purpose of the present invention.

What is claimed is:

1. A ground drilling machine comprising:

a plurality of rods;

a rod rotating mechanism for driving the rods to rotate;

a rod propelling mechanism for propelling the rods;

a leading body fitted to a front end of a leading rod so as to be rotated and propelled with the rod;

an injection port provided in the leading body to inject working liquid supplied via the rods;

a rotating condition detection section for detecting a rotating condition of said leading body as one of forward rotation, reverse rotation, and no rotation; and a flow rate control mechanism for controlling a flow rate of the working liquid based on a detection result of the rotating condition detection section.

2. The ground drilling machine according to claim 1, further comprising:

a propelling condition detection section for detecting a propelling condition of the leading body as one of forward propulsion, reverse propulsion, and no propulsion;

wherein said flow rate control mechanism is adapted to control the flow rate of the working liquid based on a detection result of said propelling condition detection section.

3. The ground drilling machine according to claim 1, further comprising:

a rotary angle detection section for detecting a rotary angle of the leading body;

wherein said injection port is adapted to inject the working liquid in a direction offset from an axis of rotation of said leading body; and wherein said flow rate control mechanism is adapted to control the flow rate of the working liquid based on a detection result of said rotary angle detection section.

4. A ground drilling machine comprising:

a plurality of rods;

a rod rotating mechanism for the driving the rods to rotate;

a rod propelling mechanism for propelling the rods;

a leading body fitted to a front end of a leading rod so as to be rotated and propelled with the rod;

an injection port provided in the leading body to inject working liquid supplied via the of rods; and a flow rate control mechanism for suspending injection of the working liquid from said injection port when said leading body is propelled and not rotated.

* * * * *